United States Patent [19]

Stuckmann et al.

[11] 4,432,665

[45] Feb. 21, 1984

[54] TUNNEL DRIVING APPARATUS

[75] Inventors: Dieter Stuckmann, Selm; Herbert Heitkamp, Werne, both of Fed. Rep. of Germany

[73] Assignee: Gewerkschaft Eisenhutte Westfalia, Lunen, Fed. Rep. of Germany

[21] Appl. No.: 297,474

[22] Filed: Aug. 28, 1981

[30] Foreign Application Priority Data

Sep. 5, 1980 [DE] Fed. Rep. of Germany ..... 3033480

[51] Int. Cl.[3] ..... E21D 9/00

[52] U.S. Cl. ..... 405/143; 299/31

[58] Field of Search ..... 405/143, 141, 142, 145; 299/31

[56] References Cited

U.S. PATENT DOCUMENTS

| | | | |
|---|---|---|---|
| 1,355,290 | 10/1920 | Updegraff | 405/143 |
| 3,301,598 | 1/1967 | Pirrie et al. | 405/143 X |
| 3,763,657 | 10/1973 | Colson | 405/143 |
| 3,784,257 | 1/1974 | Lauber et al. | 299/31 |
| 3,919,851 | 11/1975 | Plourde | 405/143 |
| 4,118,938 | 10/1978 | Unger et al. | 405/145 |
| 4,265,565 | 5/1981 | Stuckmann et al. | 405/141 X |
| 4,355,924 | 10/1982 | Hüsemann et al. | 405/141 X |

FOREIGN PATENT DOCUMENTS

| | | | |
|---|---|---|---|
| 2621421 | 1/1977 | Fed. Rep. of Germany . | |
| 453414 | 6/1968 | Switzerland . | |
| 479870 | 11/1975 | U.S.S.R. | 405/141 |

*Primary Examiner*—Ernest R. Purser
*Assistant Examiner*—Beverly E. Hjorth
*Attorney, Agent, or Firm*—Sughrue, Mion, Zinn, Macpeak & Seas

[57] ABSTRACT

Apparatus for use in driving tunnels or the like comprises a front drive shield composed, for example, of elongate cutter knives supported for longitudinal displacement on a frame. In order to control turning motion of the shield the shield is connected via hydraulic control rams to a rear abutment such as a follow-up ring structure. The rams are all inclined relative to the longitudinal axis of the apparatus. The rams are divided into two groups inclined in opposite directions and the rams of each group can be subjected collectively to pressure fluid to impart a corrective torque to the frame.

8 Claims, 2 Drawing Figures

TUNNEL DRIVING APPARATUS

BACKGROUND OF THE INVENTION

The present invention relates to apparatus for use in driving tunnels, galleries, adits, roadways and similar underground excavations referred to hereinafter simply as "tunnels".

It is known to produce a tunnel with apparatus employing a front shield which protects local equipment at the working face. The shield may be a continuous cylindrical component or a knife or drive shield composed of elongate drive members supported for displacement on a frame. Normally the shield contains such equipment as cutting appliances or devices or maybe a drifting machine and/or conveyor means for removing material detached from the working face. Where a knife or drive shield is utilized the drive members are thrust forward to penetrate the working face with the aid of hydraulic rams which advance the drive members individually or in groups. When the drive members have all been advanced the frame is drawn up by operating all the rams in unison.

In tunnel driving processes performed with apparatus as aforesaid there is often a tendency for the front shield to roll or turn about the longitudinal central axis of the apparatus and this can cause serious problems. In order to correct such a tendency and primarily to stabilize a drive or knife shield it is known from U.S. Pat. No. 4,012,916 to provide a drifting cutter which can be advanced independently to cut a channel in the floor of the tunnel. The advanced cutter then inhibits the drive shield from rotating about its axis. The drifting cutter can also be positionally displaced to enable enhanced control and guidance of the drive shield. Where the front shield is of the cylindrical type then it is known from Swiss patent No. 453 414 to provide a pressure ring inside the shield and to couple the shifting rams between the shield and the pressure ring in a flexible manner. The pressure ring is itself rotatable about its central axis by means of additional hydraulic units which can impart pre-loading torque to the pressure ring. This pre-loading torque is then transferred through the shifting rams to the main shield to compensate for any turning motion therein. It is also known from German patent No. 2 621 421 to utilize a support affixed to a follow-up rear shield which engages with guide on the front shield. The support and the guide can take up offset positions so that as the front shield is advanced it tends to turn to compensate for turning movement in the opposite direction.

A general object of the present invention is to provide an improved form of apparatus.

SUMMARY OF THE INVENTION

In accordance with the invention, a plurality of hydraulic control rams are capable of acting on the front shield of tunnel driving apparatus. In the case of a knife or drive shield the rams can act on the frame thereof.

The rams are supported at the rear by a suitable abutment which can be drawn up behind the front shield. The rams adopt an inclined position relative to the longitudinal axis of the apparatus and the tunnel with one group of rams being inclined in one direction and another group of rams being inclined in an opposite direction. By subjecting the one or the other of the groups of rams to pressure fluid torque can be applied to the front shield in either a clockwise or anti-clockwise direction.

By operating all the rams together the tendency to exert torque on the front shield is negated and the shield can be subjected to solely a longitudinal force.

The rams of the respective groups can be interspersed with one another. Conveniently, the rams can be alternately staggered and distributed around a circle with one ram of the first group disposed between two rams of the second group and vice versa.

The abutment for the rams can be a follow-up ring structure which may itself have, or connect to, a cylindrical casing forming a rear shield. Where the front shield is a knife shield the elongate drive members thereof may have rear extensions which are supported by the ring structure to form a rear shield. The rear extensions can then overlap with the casing.

The ring structure may itself be formed with inclined sleeves which receive the cylinders of the respective control rams.

Where the front shield is a drive shield, the control rams can be connected with pivot joints to the rear side of the frame supporting the elongate drive members or cutter planks and to the rear side of the aforesaid ring structure constituting the abutment. Normal shifting rams and guide means can then be provided between the drive members and their support frame. The control rams are preferably flexibly connected, e.g. pivotably connected, to the abutment and to the front shield, e.g. to the frame of the knife shield.

The invention may be understood more readily and various other features and aspects of the invention may become apparent from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
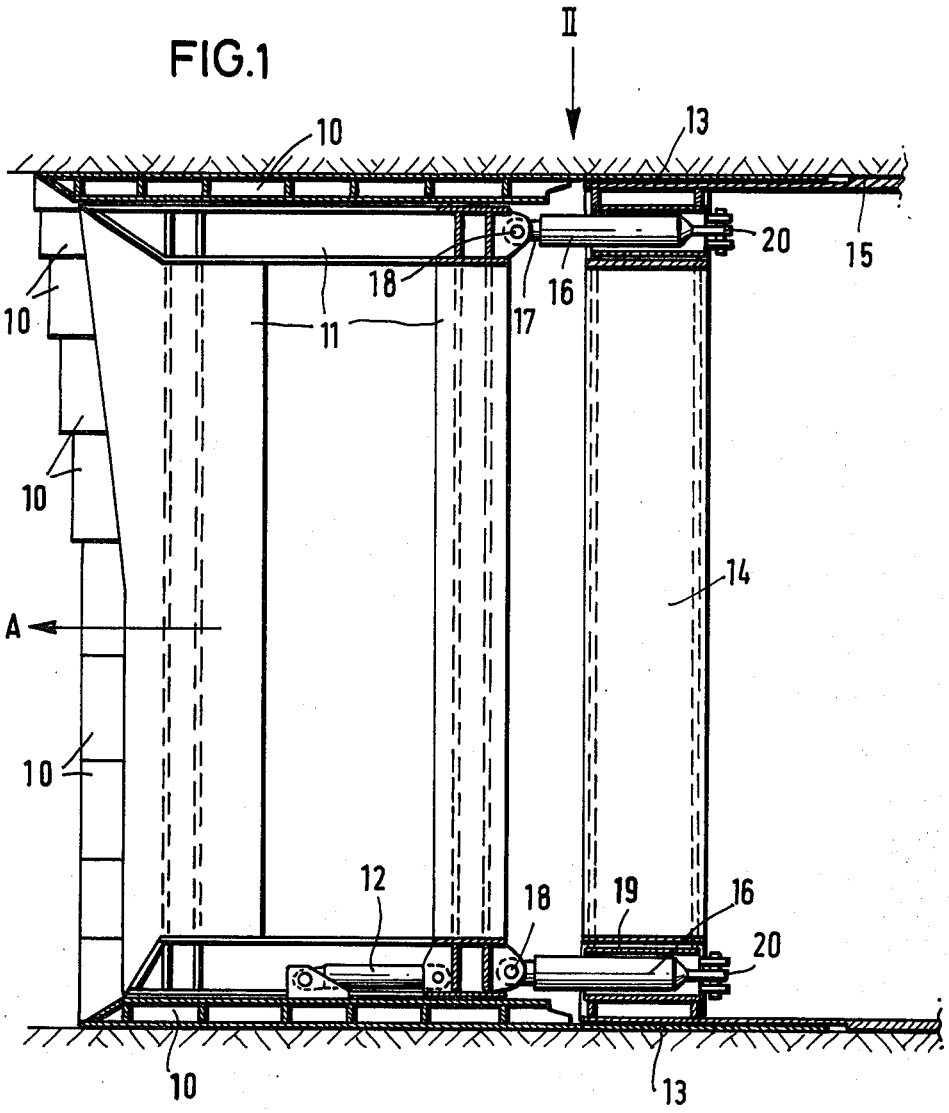
FIG. 1 is a schematic sectional side view of tunnel driving apparatus constructed in accordance with the invention.

As shown in the accompanying drawings, a tunnel driving apparatus is composed of a series of elongate drive members or knives 10 which are arranged side-by-side to form a cylindrical drive shield. The members 10 are supported for individual displacement in the driving direction A on a common frame 11. As is known, the members 10 are advanced individually or in groups to drive the tunnel progressively forwards in the direction of arrow A. This is achieved by means of double-acting hydraulic rams 12 connected between the members 10 and the frame 11. The frame 11 is itself drawn up from time to time in the direction of advancement A by operating, e.g. retracting, all the rams 12 in unison. Conveniently, each drive member 10 is associated with a respective one of the rams 12 connected in a flexible member to the drive member 10 and to the frame 11. In FIG. 1, however, only one ram 12 is depicted for the sake of clarity. The frame 11 and the drive members 10 are provided with guide means for longitudinally guiding the members 10. The guide means may take the form of T-shaped grooves slidably receiving similarly shaped guide blocks with either the blocks or the grooves on the frame 11.

The drive members 10 have reduced rear extensions which form the so-called rear tails 13. These rear extensions or tails 13 combine to form a rear shield. A follow-up bracing ring structure 14 is located within the rear shield to support the latter. A cylindrical shield casing 15 is also provided on the ring structure 14 to project rearwardly therefrom. The rear shield formed by the extensions or tails 13 and the casing 15, which also forms a rear shield, permit a lining for the tunnel wall to be installed or created. For example, fluid concrete can be pumped into an annular space delimited by the casing 15 and by other means.

Figure 2:
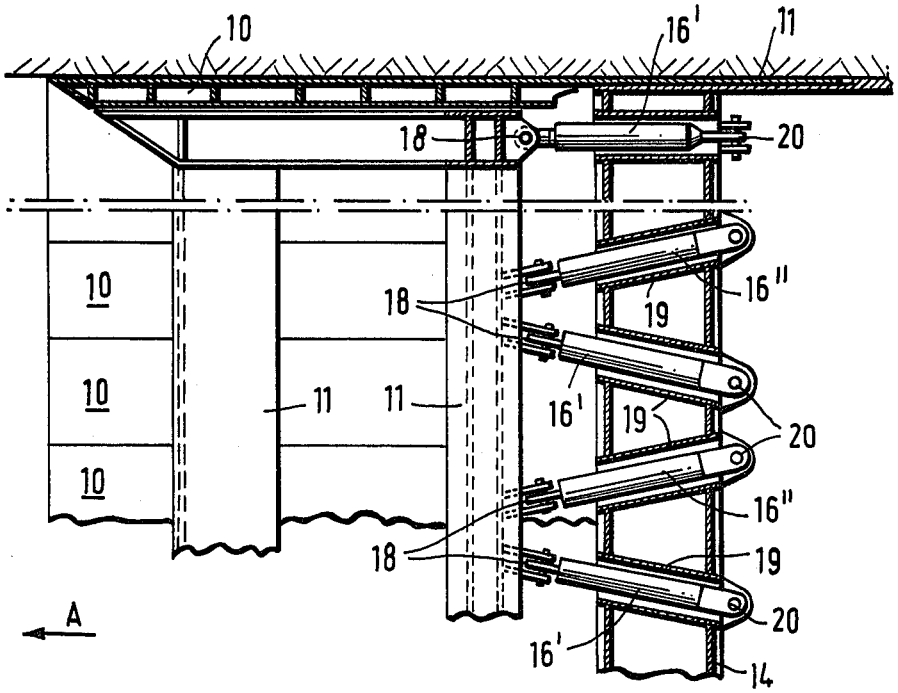
FIG. 2 is a sectional plan view of part of the apparatus taken in the direction of arrow II of FIG. 1.

A plurality of double-acting control rams 16 are connected between the ring structure 14 and the frame 11. Conveniently, the cylinders of the rams 16 connect with the ring structure 14 while their piston rods 17 connect via pivot joints 18 to the rear of the frame 11. Again for the sake of clarity only two such rams 16 are depicted in FIG. 1. It is however to be understood that a number of such rams 16 are distributed uniformly around the ring structure 14. FIG. 2 depicts the manner in which the rams 16 are mutually positioned and arranged. The rams 16 are all inclined in relation to the main longitudinal central axis of the apparatus with adjacent pairs of rams 16', 16'' converging in the direction of advancement A. The rams 16 thus form two groups, one group (16') inclined in one direction and the other group (16'') inclined in the opposite direction with the rams 16 of one group 16' alternately disposed between the rams 16 of the other group 16''. The ring structure 14 itself is provided with inclined sleeves which form openings 19 accommodating the cylinders of the rams 16 with radial clearance. The cylinders of the rams 16 connect via pivot joints 20 to the rear of the ring structure 14. Each group of rams 16 is provided with its own hydraulic control device composed of one or more valves which enables the rams 16 of the associated group to be subjected collectively to pressure fluid. In this way the control devices permit the selective operation of the groups 16', 16'' of rams 16. If the group 16' of rams 16 are all charged with pressure fluid to extend these rams 16, the frame 11 will be subjected to forces with tangential components which resolve to a force directed circumferentially clockwise of the drive shield. Conversely, extension of the group 16'' of rams 16 will produce a force directed circumferentially anti-clockwise of the drive shield. By extending the group 16' of rams 16, for example, the frame 11 will be displaced slightly clockwise through a distance largely determined by the clearance in the guide means between the frame 11 and the members 10. As the members 10 are subsequently advanced by operating the rams 12, the members 10 themselves will perform a slight lateral displacement so that overall the drive shield also undergoes a part rotation in the clockwise direction. It is thus possible to impart torque to the drive shield in either rotational direction.

The rams 16 can also serve to assist the rams 12 when the frame 11 is drawn up. In this operation all the rams 16 would be operated in unison and the opposed turning forces produced by the groups 16', 16'' of rams 16 will tend to cancel out thereby providing the desired longitudinal shifting force.

We claim:

1. In tunnel driving apparatus which includes an advanceable front drive shield composed of a series of elongate drive members mounted for movement on a common support frame and rams for effecting relative movement between the drive members and the support frame whereby to advance the drive shield and a rear abutment in the form of a follow-up ring structure; the improvement comprising a plurality of further hydraulic rams mounted between the rear abutment and the support frame of the drive shield, the further rams being arranged in first and second groups, the rams of the first group being inclined in relation to the longitudinal central axis of the apparatus in one direction and the rams of the second group being inclined in relation to the longitudinal central axis of the apparatus in a direction opposite to said one direction, the rams of either group being operable collectively in unison effectively to exert a torque on the drive shield in either a clockwise or anticlockwise direction.

2. Apparatus according to claim 1, wherein the rams of the first group are interspersed with the rams of the second group.

3. Apparatus according to claim 1, wherein the rams are alternately staggered and distributed around a circle with one ram of the first group between two rams of the second group and vice versa.

4. Apparatus according to claim 1, wherein the ring structure has a cylindrical casing forming a rear shield.

5. Apparatus according to claim 1, wherein the further rams are flexibly connected to the support frame and to the follow-up ring structure.

6. Apparatus according to claim 1, wherein the drive members have rear extensions which form a rear shield the rear extensions being supported on the follow-up ring structure.

7. Apparatus according to claim 1, wherein slidable guide means with clearance is provided between the drive members and the frame to guide the drive members for longitudinal displacement.

8. Apparatus according to claim 1, wherein the ring structure is equipped with inclined hollow sleeves which receive the cylinders of the respective further rams which connect to the rear side of the ring structure.

* * * * *